US009131828B2

(12) United States Patent
Yoon et al.

(10) Patent No.: US 9,131,828 B2
(45) Date of Patent: Sep. 15, 2015

(54) DISHWASHER

(71) Applicant: LG ELECTRONICS INC., Seoul (KR)

(72) Inventors: Sangheon Yoon, Seoul (KR); Moonkee Chung, Seoul (KR); Gapsu Shin, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/221,508

(22) Filed: Mar. 21, 2014

(65) Prior Publication Data

US 2014/0285077 A1 Sep. 25, 2014

(30) Foreign Application Priority Data

Mar. 21, 2013 (KR) ..... 10-2013-0030473

(51) Int. Cl.
*A47B 77/08* (2006.01)
*A47L 15/50* (2006.01)

(52) U.S. Cl.
CPC ..... *A47L 15/503* (2013.01)

(58) Field of Classification Search
CPC ..... A47L 15/503; A47L 15/505; A47F 5/083
USPC ..... 211/41.8, 41.9, 150; 312/228.1
See application file for complete search history.

(56) References Cited

U.S. PATENT DOCUMENTS

| | | | | |
|---|---|---|---|---|
| 3,934,728 | A * | 1/1976 | Guth | 211/41.9 |
| 7,665,475 | B2 * | 2/2010 | Hedstrom et al. | 134/134 |
| 7,766,175 | B2 * | 8/2010 | Jadhav et al. | 211/41.9 |
| 2007/0039904 | A1 * | 2/2007 | Purushothaman | 211/41.8 |
| 2007/0039905 | A1 * | 2/2007 | Purushothaman | 211/41.8 |
| 2008/0110481 | A1 * | 5/2008 | Choi et al. | 134/137 |
| 2009/0085452 | A1 * | 4/2009 | Rehage | 312/334.1 |
| 2009/0120883 | A1 | 5/2009 | Jadhav et al. | |
| 2011/0018410 | A1 * | 1/2011 | Bastuji et al. | 312/228.1 |
| 2011/0133614 | A1 * | 6/2011 | Bastuji | 312/228.1 |
| 2011/0247990 | A1 * | 10/2011 | Chai | 211/150 |
| 2011/0253650 | A1 * | 10/2011 | Renz et al. | 211/41.9 |
| 2012/0031861 | A1 * | 2/2012 | Haltmayer et al. | 211/41.9 |
| 2014/0132136 | A1 * | 5/2014 | Kilic et al. | 312/228.1 |

FOREIGN PATENT DOCUMENTS

| | | | | |
|---|---|---|---|---|
| DE | 10 2011 003 657 | A1 | 8/2012 | |
| EP | 1275336 | A1 * | 1/2003 | A47L 15/50 |
| EP | 1475030 | A2 * | 11/2004 | A47L 15/50 |
| WO | WO 2005/037050 | A1 | 4/2005 | |

OTHER PUBLICATIONS

European Search Report dated Dec. 3, 2014, issued in Application No. 14160819.0 (English translation).

* cited by examiner

*Primary Examiner* — Hanh V Tran
(74) *Attorney, Agent, or Firm* — KED & Associates, LLP

(57) ABSTRACT

The dishwasher may include a tub forming a washing space, a rack received in the washing space of the tub and having an accommodating space to receive items to be washed, and a support provided in the accommodating space of the rack to receive and support the items to be washed. The support may be inserted into the rack, and may have a rotation shaft that is formed outside the accommodating space.

18 Claims, 7 Drawing Sheets

DISHWASHER

CROSS-REFERENCE TO RELATED APPLICATION(S)

This application claims priority under 35 U.S.C. §119 to Korean Application No. 10-2013-0030473 filed in Korea on Mar. 21, 2013, whose entire disclosure is hereby incorporated by reference.

BACKGROUND

1. Field

This relates to a dishwasher, and more specifically, to a support provided at a side wall of a rack of the dishwasher.

2. Background

A dishwasher may include a rack provided in a tub to receive items to be washed, such as dishes, a washing arm that sprays washing water onto the dishes in the rack, and a washing pump and washing motor to supply washing water to the washing arm. The washing pump may pump washing water stored in a sump to the washing arm, and then washing water may be sprayed from the washing arm at high pressure onto the dishes in the rack to remove waste remaining on the dishes' surface of the dishes.

BRIEF DESCRIPTION OF THE DRAWINGS

The embodiments will be described in detail with reference to the following drawings in which like reference numerals refer to like elements wherein.

DETAILED DESCRIPTION

Figure 1:
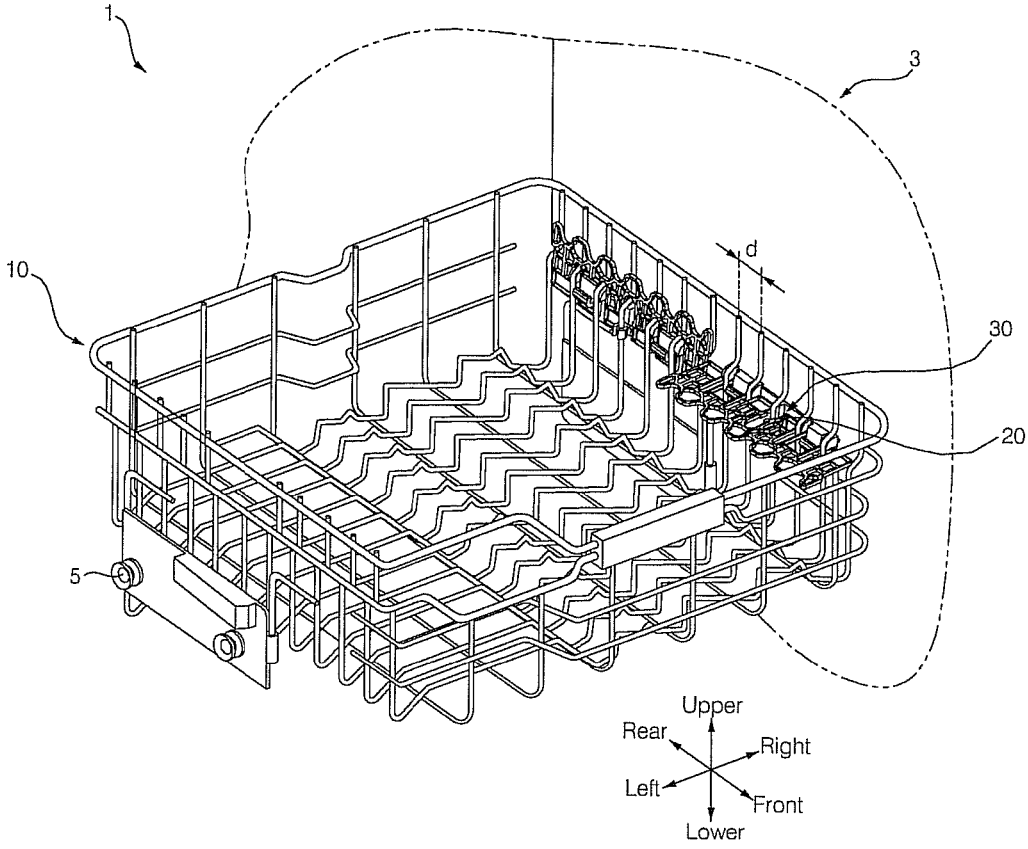
FIG. 1 is a perspective view of an interior of a dishwasher, according to an embodiment as broadly described herein.

Advantages and features of various embodiments and methods for achieving the same become apparent from the detailed description taken in conjunction with the accompanying drawings. However, embodiments are not limited thereto, and rather may be realized in other various ways. The exemplary embodiments are presented herein to fully convey the scope as broadly described herein to one of ordinary skill in the art. Wherever possible, the same denotations or reference numerals will be used refer to the same or similar elements throughout the specification.

A dish washing cycle of a dishwasher may include washing waste particles off of dishes received on a rack, rinsing the dishes after washing, and drying the dishes to remove moisture from the surface of the dishes after rinsing. After washing, the used washing water, together with detergent and waste particles, may be collected in a sump, and drained to the outside.

One or more racks may be included in a dishwasher to receive dishes for washing. In certain arrangements, two or more racks may be slidably provided. Dishes such as bowls, cups, flatware and the like may be received in each rack.

To provide for flexible arrangement of dishes in the rack, a support may be pivotably provided in a rack so that dishes may be arranged in the rack stacked one over another. The support may expand towards a center of the rack when in use, and may remain standing at a side wall of the rack when not in use. Whether or not to use the support may depend on the height of a dish to be received in the rack. However, since the support is installed on the rack, a portion of the support, which is coupled with the rack, may protrude toward an inside of the rack and interfere with dishes received therein and detract from space for accommodating dishes. The size, or width, of the support may be limited to reduce interference with other racks positioned over the support the support is positioned upright. Further, as all of the components of the support are located in the space for accommodating dishes in the rack, the support is first laid down in order to prevent collision with the dishes when moving the support up and down.

Figure 2:
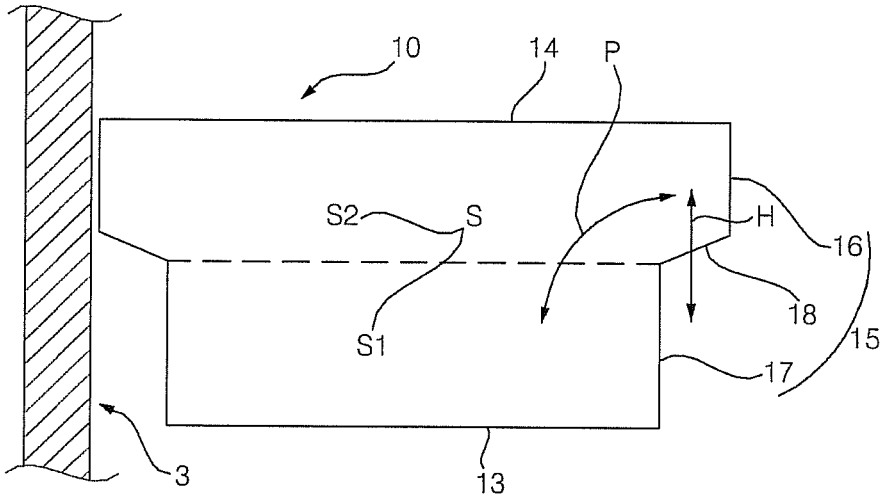
FIG. 2 illustrates movement of a rack and a support of a dishwasher, according to an embodiment as broadly described herein.
Figure 3:
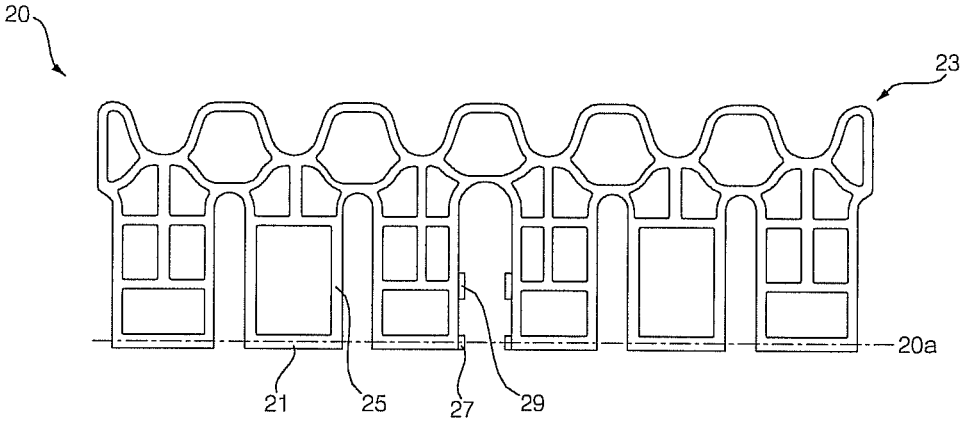
FIG. 3 illustrates a support of a dishwasher, according to an embodiment as broadly described herein.

Referring to FIGS. 1 to 3, a dishwasher 1 according to an embodiment as broadly described herein may include a tub 3 forming a space in which an item, such as, for example, a dish 7 is washed, a rack 10 forming an accommodating space S and disposed in a tub 3, and a support 20 coupled to the rack 10 and rotatable towards the accommodating space S so that the dish 7 may be mounted thereon and inserted into the rack 10. The rack 10 may rotate about a rotation shaft 20*a* positioned outside the accommodating space S.

The rack 10 may be formed of a plurality of wires which may cross each other. The rack 10 may define the accommodating space S. The rack 10 may be shaped as a basket. The rack 10 may be mounted in the tub 3. The rack 10 may be withdrawn from and inserted into the tub 3.

The support 20 may be provided in the rack 10 to be able to lie down in the accommodating space S. For example, the support 20 may be positioned at a side wall of the rack 10 so that dishes 7 may be stacked one over another in the accommodating space S. The support 20 may be left to stand in a stored position at a side wall of the rack 10, and may be expanded towards the center of the rack 10 for use.

The support 20 may be disposed in the rack 10 such that that a rotation shaft 20*a* is positioned outside the accommodating space S. For example, the rotation shaft 20*a* of the support 20 may be positioned outside the rack 10. In certain embodiments, the rotation shaft 20*a* of the support 20 may be arranged between a side wall of the rack 10 and a side wall of the tub 3. The support 20 arranged at a side wall of the rack 10 may be moved in the direction H and pivoted in the direction P.

According to an embodiment, the rack 10 may include an expansion part 18 that bends towards the tub 3, with a wire forming a side wall has an upper part that is broader than its lower part. The rotation shaft 20*a* of the support 20 may be disposed at a lower portion of the expansion part 18.

The rack 10 may include a top part 14, a bottom part 13, an upper side wall 16, a lower side wall 17, and the expansion part 18. The top part 14 may be a flat surface that is formed by a wire forming an upper end of the rack 10. The bottom part 13 may be a flat surface formed by a wire forming a lower end of the rack 10.

The wire forming the lower end of the rack may 10 extend up to form the lower side wall 17. A roller 5 may be positioned between the lower side wall 17 and the tub 3. The lower side wall may be spaced apart from the tub 3 at a predetermined distance to allow the roller 5 to be disposed therebetween.

The roller 5 may be disposed so that the rack 10 may be moved back and forth in the tub 3. The roller 5 may be positioned between a side wall of the rack 10 and a side wall of the tub 3. The roller 5 may be rotatably arranged at the lower side wall 17. The lower side wall 17 and the bottom part 13 may form a lower accommodating space S2. The upper side wall 17 may be positioned closer to a side wall of the tub 3 than the lower side wall 17 is. The upper side wall 16 may be formed of wire(s).

The upper side wall 16 and the lower side wall 17 may be formed by bending a single wire. The wire forming the lower side wall 17 may extend upward, thus forming the upper side wall 16. The wire forming the upper side wall 16 may define a larger inner area than that of the wire forming the lower side wall 17. The upper side wall 16 and the lower side wall 17 may be connected by the expansion part 18. The expansion part 18 may connect an upper end of the lower side wall 17 and a lower end of the upper side wall 16. The expansion part 18 may be inclined towards a side wall of the tub 3. An upper end of the expansion part 18 may be positioned closer to the tub 3 than a lower end of the expansion part 18 is.

The rack 10 forms the accommodating space S. The accommodating space S may include a lower accommodating space S2 and an upper accommodating space S1. The upper accommodating space S1 may be provided between the top part 14 and the lower end of the expansion part 18. The lower accommodating space S2 may be provided between the bottom part 13 and the lower end of the expansion part 18.

According to an embodiment, the support 20 may include a hook 21 forming the rotation shaft 20*a*. The hook 21 may be shorter in length than wires forming a corresponding side wall of the rack 10 so as to be inserted through the side wall of the rack 10.

The support 20 including the hook 21 may be pivotable. The rotation shaft 20*a* of the support 20 may be shaped like a rod at an end thereof, with the hook 21 forming the rotation shaft 20*a* of the support 20. In certain embodiments, hook 21 may be a protrusion that projects in the front and rear directions. However, an embodiment in which the hook 21 is a rod having a predetermined length is described. The hook 21 may be inserted between wires forming the side wall of the rack 10.

The wires forming the rack 10 may have a distance d therebetween. For example, the wires forming the expansion part 18 are spaced part from each other at a distance d. The length of the hook 21 smaller than d. The wire forming the expansion part 18 may be arranged in the upper and lower, or vertical, direction. The hook 21 may be moved up and down between the wires forming the side wall.

According to an embodiment, the support 20 may also include a flat plate part 23 disposed in the accommodating space S and a connecting part 25 that may be inserted through a space between the wires forming the rack 10 and may be connected with the rotation shaft 20*a* of the support 20. The flat plate part 23 may be positioned inside the accommodating space S. The flat plate part 23 may stand upright or may be expanded into the accommodating space S.

For example, the flat plate part 23 may lie down in the accommodating space S to receive the dish 7 thereon. Dishes 7 may be arranged on the upper and lower sides of the flat plate part 23. The flat plate part 23 may form a shelf on which dishes 7 may stack one over another. The flat plate part 23 may have multiple pores or openings through which washing water remaining on the dish 7 may flow downwards. The flat plate part 23 may have a fixed protrusion to prevent the dish 7 received thereon from sliding away. The flat plate part 23 may be connected with the connecting part 25.

The connecting part 25 may be inserted through a space formed between adjacent wires of the rack 10. The connecting part 25 may be connected with the rotation shaft 20*a* of the support 20. The connecting part 25 may be connected with the hook 21. The connecting part 25, the hook 21, and the flat plate part 23 may be connected with one another, forming a somewhat rectangular periphery. A hinge 31, to be described below, may be arranged to be moveable up and down in the rectangular periphery. The rectangular periphery may somewhat limit the movement of the flat plate part 23, and may fasten the flat plate part 23 to a bracket 30, and to the rack 10.

According to an embodiment, the dishwasher 1 may include the roller 5 at the side wall to enable the rack 10 to move back and forth in the tub 3. The rack 10 may include the lower side wall 17 spaced apart from the side wall of the tub 3 to accommodate the roller 5 and the upper side wall 16 that is arranged closer to the side wall of the tub 3 than the lower side 17 is so as to form an upper accommodating space S1 that is broader than the lower accommodating space S2 formed by the lower side wall 17. The rotation shaft 20*a* of the support 20 may be positioned between the lower side wall 17 and the tub 3.

The roller 5 is positioned between the lower side wall 17 and the tub 3. The lower side wall 17 is spaced apart from the tub 3 at a predetermined distance to accommodate the roller 5. The roller 5 may allow the rack 10 to be withdrawn from an inserted into the tub 3. The roller 5 may be positioned between a side wall of the rack 10 and a side wall of the tub 3. The roller 5 may be rotatably arranged at the lower side wall 17. The upper side wall 16 may be positioned closer to the side wall of the tub 3 than the lower side wall 17 is. The upper side wall 16 and the lower side wall 17 may be formed by bending a single wire, or multiple interconnected wires. The upper side wall 16 may be formed by extending the wire forming the lower side wall 17 along an upper side. The wire forming the upper side wall 16 may define a larger inner area than the wire forming the lower side wall 17.

The upper side wall 16 and the lower side wall 17 may be connected by the expansion part 18. The expansion part 18 may extend between an upper end of the lower side wall 17 and a lower end of the upper side wall 16. The expansion part 18 may be inclined toward the side wall of the tub 3, with the upper end of the expansion part 18 positioned close to the side wall of the tub 3.

According to an embodiment of the present invention, the support 20 may be inserted through a space between adjacent wires forming the expansion part 18. The rotation shaft 20*a* of the support 20 may pass through spaces between adjacent wires forming the rack 10. The rotation shaft 20*a* of the support 20 may move up and down along the expansion part 18. The hook 21 may be disposed between the lower side wall 17 and the side wall of the tub 3. The hook 21 may be arranged at a lower end of the expansion part 18 to move up and down the expansion part 18, passing through spaces formed between adjacent wires forming the rack 10.

Figure 4:
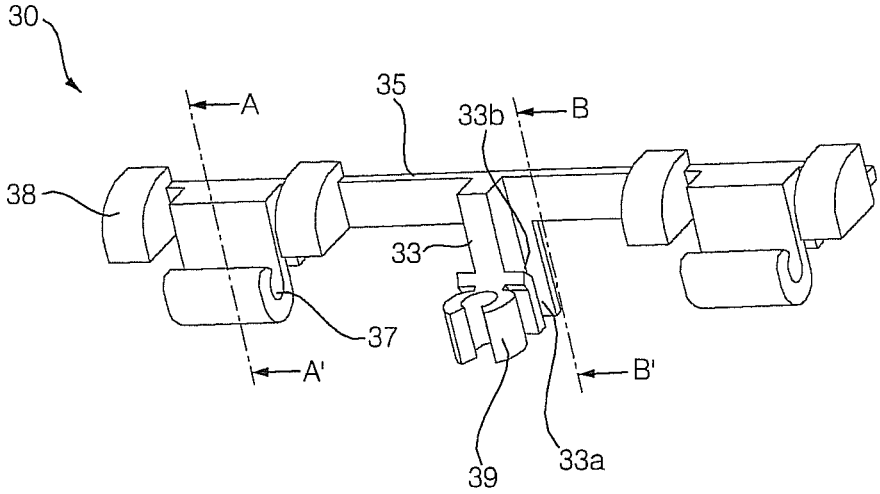
FIG. 4 illustrates a bracket of a dishwasher, according to an embodiment as broadly described herein.
Figure 5:
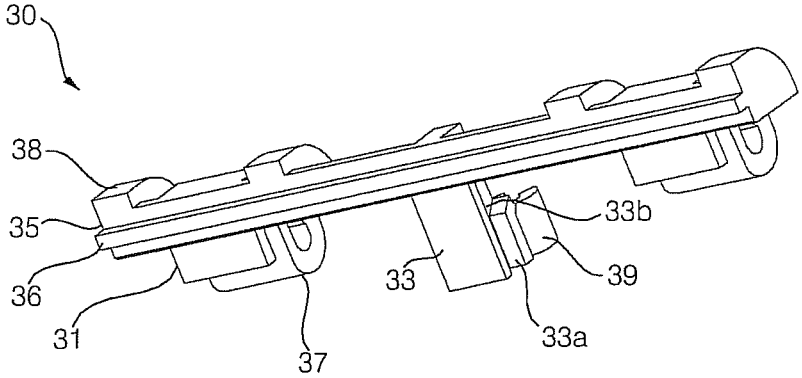
FIG. 5 is a perspective view of a bracket of a dishwasher, viewed in another direction, according to an embodiment as broadly described herein.
Figure 6:
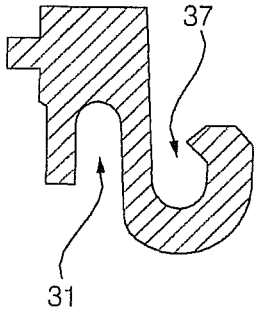
FIG. 6 is a cross-sectional view taken along line A-A' of FIG. 4.
Figure 7A:
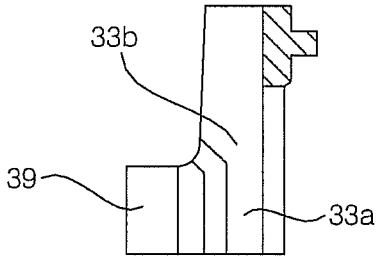
FIG. 7A is a cross-sectional view taken along line B-B' of FIG. 4.
Figure 7B:
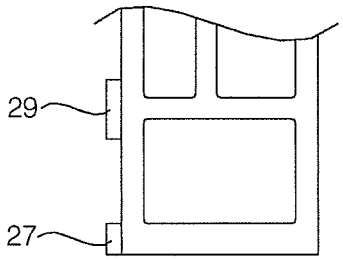
FIG. 7B illustrates a corresponding portion of the support.
Figure 8A:
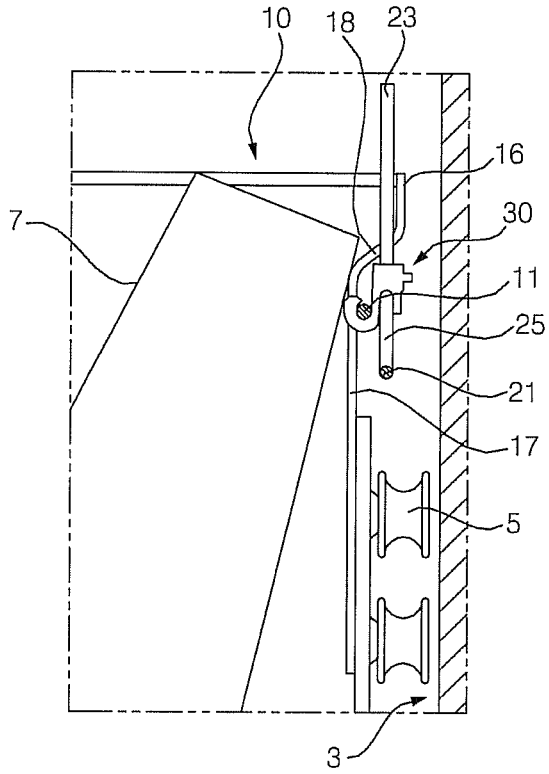
FIGS. 8A-8B illustrate a location of a support of a dishwasher according to an embodiment as broadly described herein.
Figure 8B:
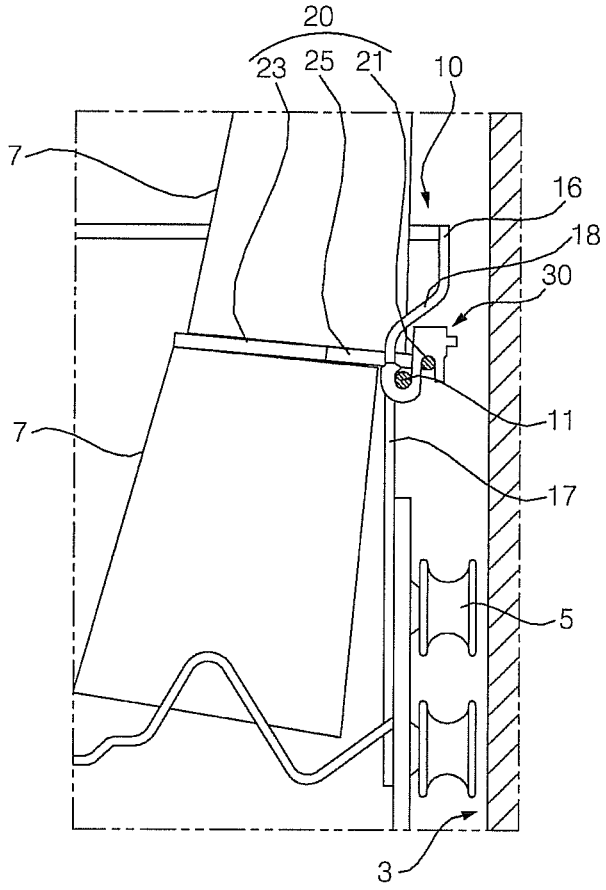

FIGS. 4 and 5 are front and back perspective views of a bracket 30 of a dishwasher 1, according to an embodiment as broadly described herein, FIG. 6 is a cross-sectional view taken along line A-A' of FIG. 4, FIG. 7A is a cross-sectional view taken along line B-B' of FIG. 4, and FIGS. 8A-8B illustrate a location of a support 20 of a dishwasher 1, according to an embodiment as broadly described herein.

Referring to FIGS. 4 to 8, the dishwasher 1 according to an embodiment as broadly described herein may include a bracket 30 provided at a side wall of the rack 10 and hinge-coupled with the support 20. The bracket 30 may be mounted to a wire at the side wall of the rack 10.

The bracket 30 may include a hinge 31 that is opened facing a lower portion of the tub 3 so as to be hinge-coupled to the support 20 as the rotation shaft 20*a* of the support 20 moves up and to release the hinge-coupling as the rotation shaft 20*a* of the support 20 moves down. The hinge 31 may be formed as, for example, a recess in the bracket 30.

The hinge 31 may be somewhat ring shaped, with an opening at its lower end, and rounded downward, so that it forms a hinge coupling as the hook 21 moves up and releases the hinge coupling as the hook 21 moves down. The bracket 30 may include one or more hinges 31. In certain embodiments, the bracket 30 may include two or more hinges 31.

The bracket 30 includes a vertical arm 33 that is elongated in the upper and lower, or vertical, direction. The vertical arm 33 may include a guide groove 33*a* that is formed in the upper and lower, or vertical, direction and an expanded groove 33*b* that is formed by expanding the width of an upper end of the guide groove 33*a*.

The bracket 30 may include the vertical arm 33 that guides up-and-down movement of the support 20. The bracket 30 may also include a body 35 that is elongated in the front and rear, or horizontal, or longitudinal, direction of the bracket 30.

The body 35 may include the vertical arm 33, the hinge 31, a seating part 37, and a pressurizing part 38. The body 35 may be shaped like, for example, an elongated rod or arm. The vertical arm 33 may be shaped like a long stick. The body 35 may support the flat plate part 23 to prevent the flat plate part 23 from being inclined toward the side wall of the tub 3 when moving the flat plate part 23 into an upright position. The body 35 may be spaced apart from a wire provided at the seating part 37 and a holder 39 provided on the vertical arm 33. The connecting part 25 of the support 20 may be inserted through a space between the body 35 and the wire, with the body 35 spaced apart from the wire. The body 35 may be oriented toward the side wall of the tub 3. The body 35 may include a rib 36.

The rib 36 may support the body 35 to maintain the rigidity of the body 35 and may project from the body 35 toward the side wall of the tub 3, longitudinally, in a front to rear direction of the rack 10. A main protrusion 27 and a sub protrusion 29 of the support 20 may be inserted into the guide groove 33*a*, and may travel to the guide groove 33*a* via the expanded groove 33*b* and may be detached.

The main protrusion 27 may project in the direction of the rotation shaft 20*a* of the support 20 and be inserted into the guide groove 33*a* of the bracket 30 so that the support 20 may be moved which is mounted on the bracket 30.

The sub protrusion 29 may be formed in the radial direction from the rotation shaft 20*a* of the support 20 to allow for up-and-down movement along the guide groove 33*a*. The sub protrusion 29 may be inserted into and detached from the guide groove 33*a* via the expanded groove 33*b*. The sub protrusion 29 may be formed above the main protrusion 27. The main protrusion 27 and the sub protrusion 29 may be formed at the connecting part 25 of the support. The sub protrusion 29 may be longer than the main protrusion 27. The sub protrusion 29 may be detached from the guide groove 33*a* as the support 20 is moved toward the accommodating space S.

The expanded groove 33*b* may be provided at an upper end of the guide groove 33*a* to allow the sub protrusion 29 to be detached. The expanded groove 33*b* may be relatively broad so that the sub protrusion 29 and the main protrusion 27 may be introduced into the guide groove 33*a*.

The seating part 37 of the bracket 30 may be shaped like a hook protruding toward the rack 10, which is engaged by the wire to the rack 10 to restrict up-and-down movement of the bracket 30.

The seating part 37 may have a ring-shaped upper side. The bracket 30 may include one or more seating parts 37. In certain embodiments, the bracket 30 may include two or more seating parts 37. The rack 10 may include a fixed wire 11 that is inserted into the seating part 37. The fixed wire 11 may extend along the front and rear direction of the rack 10. The fixed wire 11 may be arranged at a side wall of the rack 10. For example, the fixed wire 11 may be formed at the lower side wall 17. In particular, the fixed wire 11 may be disposed at a lower end of the expansion part 18 so that the bracket 30 may be positioned above the roller 5.

The pressurizing part 38 of the bracket 30 may apply pressure to the wire stuck to the hook at an opposite side of the hook. The pressurizing part 38 may pressurize the fixed wire 11.

The pressurizing part 38 may apply pressure on the fixed wire 11 toward the seating part 37. The pressurizing part 38 and the seating part 37 may be arranged above and below the fixed wire 11. In one embodiment, the pressurizing part 38 may be positioned above of the fixed wire 11, and the seating part 37 may be positioned below the fixed wire 11.

The bracket 30 may include the holder 39 receiving therein the wire forming the rack 10 to restrict the horizontal movement of the bracket 30. The holder 39 may be provided on the vertical arm 33. The holder 39 may be open toward the accommodating space S. The holder 39 may have a degree of elasticity that allows for insertion and removal. The holder 39 may be coupled with the wire forming the lower side wall 17 of the rack 10, and in particular, a wire that extends in the upper and lower, or vertical, direction.

According to an embodiment as broadly described herein, the dishwasher 1 may include a tub 3 forming a space for washing a dish 7, a rack 10 forming an accommodating space S in the tub 3 and having a lower portion and an upper portion that is more broad than the lower portion so that a top part 14 forming a top surface of the accommodating space S is broader than a bottom part 13 forming a lower surface of the dishes accommodating space S, and a support 20 that may be disposed at a side wall of the rack 10 so that its upper end is oriented in an upright position toward the top part 14 of the rack 10, and its lower end does not face the bottom part 13.

According to an embodiment as broadly described herein, the dishwasher 1 may include a tub 3 forming a space for washing a dish 7, a rack 10 disposed in the tub 3 and forming an accommodating space S, and a support 20 that may be laid down in the accommodating space S and whose end may be coupled to the wires forming the rack 10 and projected outside the rack 10 so as to not unnecessarily consume a portion of the accommodating space S.

According to an embodiment as broadly described herein, the dishwasher 1 may include a bracket 30 that is mounted at the rack 10 to support the support 20 and to allow the rotation shaft 20*a* of the support 20 to be spaced apart from the wire forming a side wall of the rack 10. The bracket 30 may be mounted to the wire forming the rack 10. The bracket 30 may space the rotation shaft 20*a* of the support 20 apart from the rack 10.

According to an embodiment as broadly described herein, the support 20 may be formed so that a side portion thereof is projected in a tooth pattern, which allows the support 20 to be inserted through a space formed between adjacent wires forming the rack 10. The end of the tooth-shaped part of the support 20 may form the rotation shaft 20*a*. A width of each tooth-like protrusion than a distance d between adjacent wires.

According to an embodiment as broadly described herein, the dishwasher 1 may include a tub 3 forming a space for washing a dish, a rack 10 having an accommodating space S and disposed in the tub 3, a support 20 that may be laid down toward the dishes accommodating space S to receive dishes and may be inserted through a space between adjacent wires forming the rack 10, and a bracket 30 that may be mounted at the rack 10 and that may be selectively hinge-coupled with the rotation shaft 20*a* of the support 20 as the support 20 is moved up and down.

According to an embodiment as broadly described herein, the dishwasher 1 may include a tub 3 forming a space for washing dishes, a rack 10 having an accommodating space S and disposed in the tub 3, and a support 20 that may be laid down in the accommodating space S to receive dishes and that may be moved downward, inserted through a space between adjacent wires forming the rack 10 so that the area of arrangement in the accommodating space S is reduced in an upright position as compared with when it is put in a laid position.

The support 20 may be moved up and down, inserted between adjacent wires forming the rack 10, so that a portion thereof remains in the accommodating space S while the remainder thereof is projected to the outside of the rack 10, thus not detracting storage space from the accommodating space S. The area of the support 20, which remains in accommodating space S, may vary depending on the position of the support 20. The support 20 may be lifted and laid down. As the support 20 is lifted up, the area of the support 20 may be increased. The support 20 may move down until it is engaged by the wire forming the rack 10. Accordingly, the area of the support 20 may be reduced as much as the support 20 is moved. The area of the support 20 may refer to an area that remains in the accommodating space S.

The operation of the dishwasher 1 configured as above, according to embodiments, is described below.

A user puts a dish 7 to be washed in the rack 10. The user would not need to use the support 20 if there are not many dishes 7 or if the dish 7 to be washed is relatively large or tall or irregularly shaped. In such case, the user leaves the support 20 in a standing position at a side wall of the rack 10. First, the user puts the support 20 from an extended position in which it extends toward the accommodating space S to an upright position toward the side wall of the rack 10. Then, the user may adjust the height of the support 20 by moving the support 20 down in the vertical direction.

The support 20 may move up and down between the side wall of the rack 10 and the body 35, and thus, does not fall down as it moves down. Further, the vertical 33 includes the guide groove 33*a*, and the main protrusion 27 and the sub protrusion 29 are inserted into the guide groove 33*a* via the expanded groove 33*b*, thus enabling stable vertical movement.

Further, if the support 20 stand S upright, inserted into the side wall of the rack 10, the rotation shaft 20*a* is arranged at an outside of the rack 10, thus minimizing the area that invades the accommodating space S. More specifically, the support 20 invades only the upper accommodating space S1. Accordingly, the support 20 does not invade the lower accommodating space S2.

In a case in which more dishes 7 are to be accommodated in the rack 10, the user arranges a smaller dish 7 at a side wall of the rack 10. Thereafter, the support 20 is shifted upward from the upright position. The main protrusion 27 and the sub protrusion 29 are moved to the upper side along the guide groove 33*a*, and at a predetermined height, the sub protrusion 29 is detached to the upper side via the expanded groove 33*b*. Further, the hook 21 is fixed to the hinge 31. If the hook 21 and the hinge 31 are hinge-coupled with each other, the support 20 ends up being in a state where it can pivot. The user pivots and lays the support 20 down onto the first dish 7 and then may place additional dishes 7 on the support 20.

By the above configuration, the hook 21 of the support 20 is always arranged outside the rack 10, and in a case in which the support 20 is not used, the accommodating space may be maximized. Further, since there is no interference between the support 20 and the dish 7 during up-and-down movement, it is not required to move or rearrange dishes already received in the rack 10 to actuate/extend the support 20 for use.

A dishwasher is provided in which the likelihood that a support will reduce a dishes accommodating space is minimized.

A dishwasher is provided in which interference with other racks may be prevented without reducing the width of the support.

A dishwasher is provided in which interference with dishes in the rack may be prevented when the support moves up and down.

A dishwasher is provided in which a support may be freely maneuvered in a rack even while dishes are accommodated.

A dishwasher according to an embodiment as broadly described herein may include a tub forming a space for washing a dish, a rack forming a dishes accommodating space and disposed in the tub, and a support lying down toward the dishes accommodating space to mount the dish, the support is inserted into the rack, the support having a rotation shaft that is formed outside the dishes accommodating space.

The rack may include an expansion part formed by bending a wire forming a side wall toward the tub so that an upper part is broader than a lower part in terms of the dishes accommodating space, and wherein the rotation shaft of the support is disposed at a lower side of the expansion part.

The support may include a hook forming the rotation shaft, and wherein the hook is formed to be shorter than a distance between wires forming a side wall of the rack so as to be inserted through the side wall of the rack.

The support may also include a flat plate part disposed in the dishes accommodating space and a connecting part inserted through a space between wires forming the rack and connected with the rotation shaft of the support.

A dishwasher according to an embodiment as broadly described herein may include a roller provided at a side wall of the rack so that the rack moves back and forth in the tub, wherein the rack includes a lower side wall part spaced apart from a side wall of the tub to mount the roller and an upper side wall part positioned closer to the side wall of the tub than the lower side wall part is so as to form an upper dishes accommodating space that is broader than a lower dishes accommodating space in which the lower side wall part is formed, and wherein the rotation shaft of the support is disposed between the lower side wall part and the side wall of the tub.

The support may be disposed to be inserted through a space between the upper side wall part and the lower side wall part.

The rack may also include an expansion part that is inclined toward the side wall of the tub to connect the lower side wall part with the upper side wall part, and wherein the support is erected toward an upper side of the expansion part.

The support may be inserted through a space between wires forming the expansion part.

A dishwasher according to an embodiment as broadly described herein may include a bracket that is provided at a side wall of the rack and is hinge-coupled with the support.

The bracket may include a hinge that is opened toward a lower side of the tub so that as the rotation shaft of the support is moved up, a hinge coupling is formed while as the rotation shaft of the support is moved down, the hinge coupling is released.

The bracket may include a vertical part that is formed long in upper and lower directions, and wherein the vertical part includes a guide groove formed in upper and lower directions and an expanded groove formed by expanding a width of an upper side of the guide groove.

The support may include a main protrusion that is projected in a direction of the rotation shaft of the support and is inserted to the guide groove.

The support may also include a sub protrusion that is formed in a radius direction from the rotation shaft of the support so as to be moved along the guide groove in upper and lower directions, and wherein the sub protrusion is inserted to the guide groove through the expanded groove.

The bracket may include a hook-shaped seating part that is projected toward the rack to be stuck by a wire forming the rack to restrict up-and-down movement of the bracket.

The bracket may also include a pressurizing part that is projected to pressurize the wire stuck by the hook at an opposition side of the hook.

The bracket may also include a peg-shaped holder that is provided with a wire forming the rack to restrict a horizontal movement of the bracket.

A dishwasher according to an embodiment as broadly described herein may include a bracket that supports the support and that is provided in the rack so that the rotation shaft of the support is spaced apart from a wire forming a side wall of the rack.

The support may have a tooth-shaped side that is projected to be inserted through a space between wires forming the rack.

A dishwasher according to an embodiment as broadly described herein may include a tub forming a space for washing a dish, a rack forming a dishes accommodating space and disposed in the tub, a support lying down toward the dishes accommodating space to mount the dish, the support inserted through a space between wires forming the rack when put in an upright position, and a bracket provided in the rack, the bracket selectively hinge-coupled with a rotation shaft of the support as the support moves up and down.

A dishwasher according to an embodiment as broadly described herein may include a tub forming a space for washing a dish, a rack forming a dishes accommodating space and disposed in the tub, and a support disposed to move up and down, inserted between a space between wires forming the rack, so that a portion of the support remains in the dishes accommodating space while a remaining portion of the support is projected to an outside of the rack.

In a dishwasher as embodied and broadly described herein, a rotation shaft of a support does not protrude into a dishes accommodating space of a rack.

In a dishwasher as embodied and broadly described herein, interference with other racks may be prevented even without reducing a width of the support.

In a dishwasher as embodied and broadly described herein, even when dishes are accommodated in the rack when the support is in use, the support does not hit the dishes, thus enabling the support to be freely used.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dishwasher, comprising:

a tub that forms a washing space;

a rack provided in the tub, that forms a receiving space configured to receive items to be washed;

a support rotatably coupled to the rack, wherein the support comprises a rotational shaft positioned outside of the receiving space formed in the rack such that the support is rotatable about the rotational shaft at least from a first position at which the support is positioned in the receiving space to receive an item to be washed thereon to a second position at which the support is positioned against a side wall of the rack for storage; and a bracket coupled to the side wall of the rack and rotatably coupled with the support, wherein the bracket includes a hinge having an opening that faces a lower portion of the tub, and wherein the hinge is configured to receive the rotational shaft of the support therein as the rotational shaft is moved upward to rotatably couple the support to the bracket, and to release the rotational shaft of the support therefrom as the rotational shaft is moved downward to de-couple the rotational shaft from the bracket.

2. The dishwasher of claim 1, wherein the rack comprises:

a lower storage area;

an upper storage area positioned above the lower storage area; and an expansion section that extends from a top end of the lower storage area to a bottom end of the upper storage area, such that a width of the upper storage area is greater than a width of the lower storage area, and wherein the rotational shaft is positioned at a lower end of the expansion section.

3. The dishwasher of claim 2, wherein a distance between an upper side wall of the rack, corresponding to the upper storage area, and a corresponding sidewall of the tub, is less than a distance between a lower sidewall of the rack, corresponding to the lower storage area, and the corresponding sidewall of the tub, and wherein the dishwasher further comprises a plurality of rollers coupled to the lower side wall of the rack, between the lower storage area and the tub.

4. The dishwasher of claim 1, wherein the rotational shaft of the support comprises a hook, and wherein a length of the hook is less than a distance between adjacent wires that form an opening in the side wall of the rack, such that the hook is inserted through the opening formed in the side wall of the rack by the adjacent wires.

5. The dishwasher of claim 1, wherein the support further comprises:

a connecting portion coupled to the rack by the rotational shaft, that extends through a space formed between adjacent wires that form the side wall of the rack; and a flat plate portion coupled to the connecting portion and configured to extend into the receiving space in the first position of the support.

6. The dishwasher of claim 1, further comprising at least one roller provided at the side wall to roll the rack into and out of the tub, wherein the rack comprises:

a bottom wall;

a lower side wall that extends upward from the bottom wall and spaced apart from a corresponding side wall of the tub by a first predetermined distance, wherein the lower side wall defines a lower receiving area of the receiving area formed by the rack, and wherein the at least one roller is coupled to the lower side wall of the rack; and an upper side wall positioned above the lower side wall and spaced apart from the corresponding side wall of the tub by a second predetermined distance which is less than the first predetermined distance, wherein the upper side wall defines an upper receiving area of the receiving area formed by the rack, wherein a width of the upper receiving area is greater than a width of the lower receiving area, and wherein the rotational shaft of the support is disposed between the lower side wall and the side wall of the tub.

7. The dishwasher of claim 6, wherein the support is coupled to and inserted into the rack through a space formed between the upper side wall and the lower side wall.

8. The dishwasher of claim 6, wherein the rack further comprises:

an expansion wall that extends upward at an incline toward the side wall of the tub, from a top end of the lower side wall to a bottom end of the upper side wall, and wherein the support is coupled to the expansion wall of the rack and is inserted through a space formed between adjacent wires that form the expansion wall of the rack.

9. The dishwasher of claim 1, wherein the bracket further comprises a body from which the hinge protrudes.

10. The dishwasher of claim 9, wherein the bracket further comprises:

a vertical arm that protrudes from the body, the vertical arm including a guide groove that extends vertically therein and an expanded groove formed at an upper end of the guide groove, and wherein the expanded groove has a width that is greater than a width of the guide groove.

11. The dishwasher of claim 10, wherein the support comprises a main protrusion that projects in a direction of the rotational shaft and is configured to be inserted into the guide groove.

12. The dishwasher of claim 11, wherein the support further comprises a sub protrusion that extends radially from the rotational shaft and is configured to move along the guide groove, and wherein the sub protrusion is inserted into the guide groove through the expanded groove.

13. The dishwasher of claim 9, wherein the bracket comprises a hook-shaped seat provided on the body, that projects toward the rack so as to engage a wire that forms the rack and restrict vertical movement of the bracket.

14. The dishwasher of claim 13, wherein the bracket further comprises a pressurizing portion provided on the body and configured to apply pressure to the wire received in the seat at an opposite side of the seat.

15. The dishwasher of claim 1, wherein the bracket further comprises a holder configured to engage a wire that forms the rack to restrict horizontal movement of the bracket.

16. The dishwasher of claim 1, wherein the rotational shaft of the support is spaced apart from a wire that forms the side wall of the rack.

17. The dishwasher of claim 1, wherein an edge of the support is formed in a tooth-shaped pattern configured to be inserted through a plurality of spaces formed between adjacent wires that form the rack.

18. A dishwasher, comprising:

a tub that forms a washing space;

a rack provided in the tub, that forms a receiving space configured to receive items to be washed;

a support coupled to the rack and configured to rotate into the receiving space of the rack so as to form a receiving surface on which items to be washed are received, and to rotate out of the receiving space for storage in an upright position, wherein the support is inserted into the receiving space through a space formed between adjacent wires that form the rack; and a bracket coupled to the rack, wherein the bracket is selectively coupled to and decoupled from a rotational shaft of the support as the support moves up and down relative to the bracket.

* * * * *